US007401938B1

(12) United States Patent
Cheng

(10) Patent No.: US 7,401,938 B1
(45) Date of Patent: Jul. 22, 2008

(54) EXTENSION BAR WITH BUILT-IN LIGHT

(76) Inventor: Chin-Shun Cheng, No. 37-2, Ching-Dau 1st Street, Taichung (TW) 404

( * ) Notice: Subject to any disclaimer, the term of this patent is extended or adjusted under 35 U.S.C. 154(b) by 0 days.

(21) Appl. No.: 11/833,257

(22) Filed: Aug. 3, 2007

(51) Int. Cl.
*B25B 23/18* (2006.01)

(52) U.S. Cl. ..... 362/120; 362/119

(58) Field of Classification Search ..... 362/120, 362/119

See application file for complete search history.

(56) References Cited

U.S. PATENT DOCUMENTS 3,185,832 A * 5/1965 Nagamori ..... 362/120
3,919,541 A * 11/1975 Chao ..... 362/120
5,577,829 A * 11/1996 Hall ..... 362/119
5,845,986 A * 12/1998 Breen ..... 362/119
6,183,103 B1 * 2/2001 Hillinger ..... 362/119
6,508,565 B2 * 1/2003 Wang ..... 362/119
6,712,484 B2 * 3/2004 Hsien ..... 362/119
6,843,579 B2 * 1/2005 Chen ..... 362/119

* cited by examiner

*Primary Examiner*—Hargobind S Sawhney

(57) ABSTRACT

An extension bar with built-in light includes an elongate body having an open first end and an engaging recess in a second end of the elongate body. A switch member with a first conductive member extends through a transverse hole of the elongate body. A carrier is received in the engaging recess and a second conductive member is connected to the carrier. A power supply unit and a light bulb are received in the passage. The first end of the second conductive member is moved to contact the power supply unit to activate the light bulb when a conductive hand tool is inserted into the engaging recess. The light bulb is also activated when rotating the switch member to contact directly the first conductive member, the second conductive member and the power supply unit.

15 Claims, 11 Drawing Sheets

EXTENSION BAR WITH BUILT-IN LIGHT

FIELD OF THE INVENTION

The present invention relates to an extension bar which includes a built-in light which is activated by either a switch member on the extension bar or by a hand tool engaged with the extension bar.

BACKGROUND OF THE INVENTION

A conventional hand tool can be connected with variety of connection bars or extension bars which includes accommodation recesses so as to be connected with different tool bits. U.S. Pat. Nos. 5,477,434 and 6,183,103 respectively disclose an extension bar with built-in light to be cooperated with hand tools. The built-in light of U.S. Pat. No. 5,477,434 can be activated when a hand tool is connected with the extension bar, and built-in light of U.S. Pat. No. 6,183,103 cannot be activated by the connection of the hand tool, a switch has to be operated to activate the built-in light.

The present invention intends to provide an extension bar with a built-in light which can be activated by either being connected with a hand tool or by operation of a switch member on the extension bar.

SUMMARY OF THE INVENTION

The present invention relates to an extension bar with built-in light which comprises a conductive elongate body having a first end and an engaging recess defined in a second end of the elongate body. A passage is defined axially through the elongate body and communicates with the engaging recess and defines an opening in the first end of the elongate body. A switch member made by non-conductive material extends a transverse hole defined through the elongate body and a first conductive member is connected to the switch member. The first conductive member is exposed on an outer surface of the switch member and in contact with an inner periphery of the transverse hole. A carrier made by non-conductive material is received in the engaging recess and a second conductive member is connected to the carrier. A first end and a second end of the second conductive member are respectively located at a first end of the carrier and a second end of the carrier. A gap is defined between the second conductive member and the elongate body. A power supply unit and a light bulb are received in the passage. The first end of the light bulb is made by conductive material and in contact with an inner periphery of the passage. A second end of the light bulb faces the opening in the first end of the elongate body.

The second conductive member together with the carrier are pushed by a hand tool inserted into the engaging recess so as to be electrically connected with the power supply unit to activate the light bulb.

The light bulb can also be activated simply by rotating the switch member to contact the conductive body, the first conductive member, the power supply unit and the light bulb.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
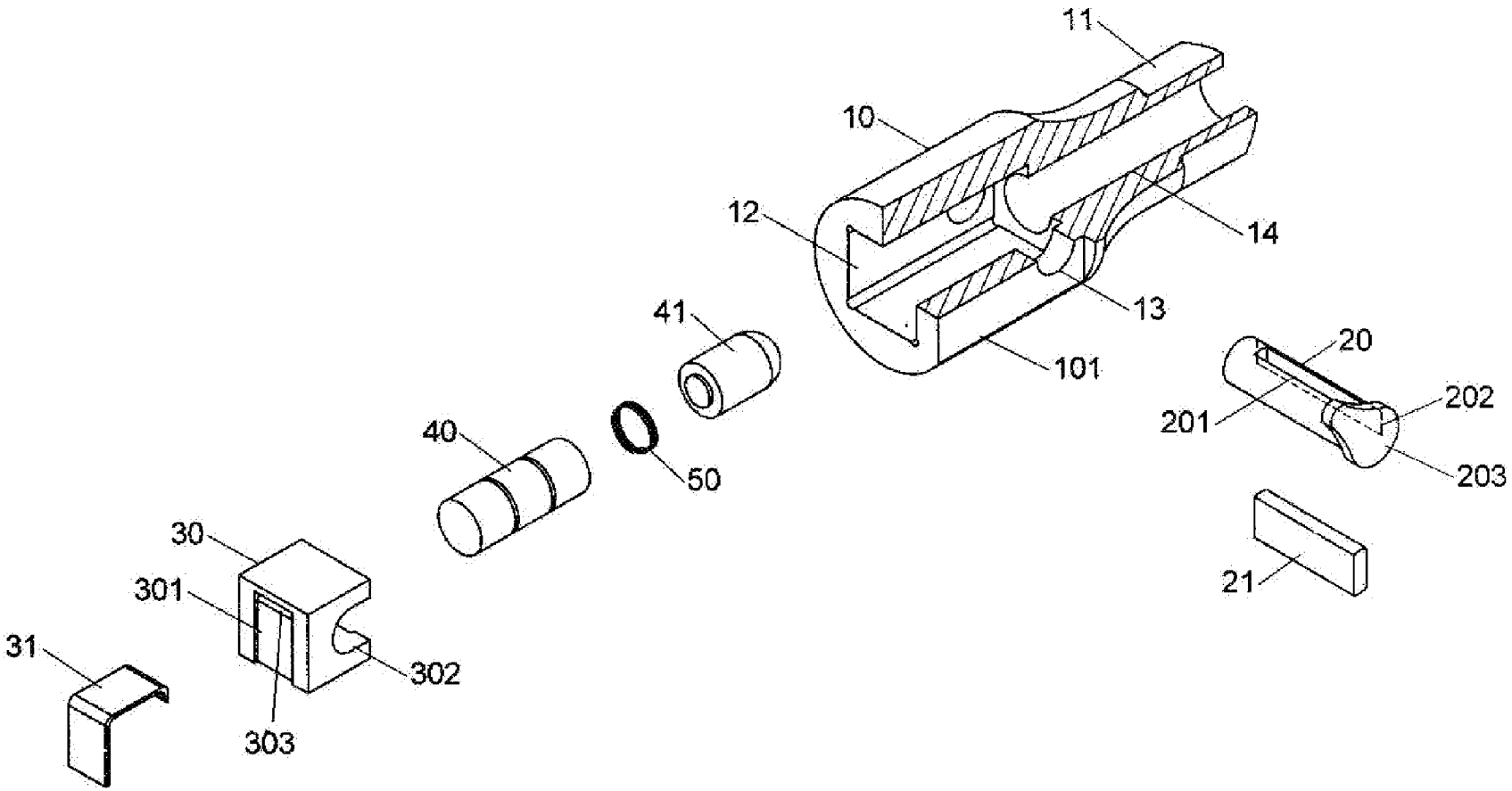
FIG. 1 is an exploded view to show the extension bar with a built-in light of the present invention.
Figure 2:
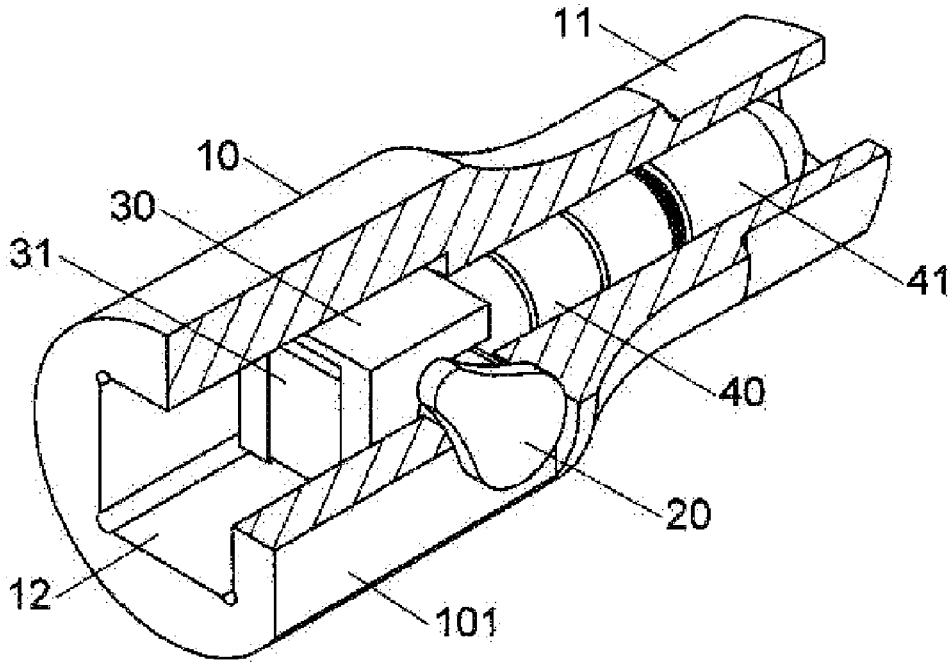
FIG. 2 is a partially cross sectional view of the extension bar with a built-in light of the present invention.
Figure 3:
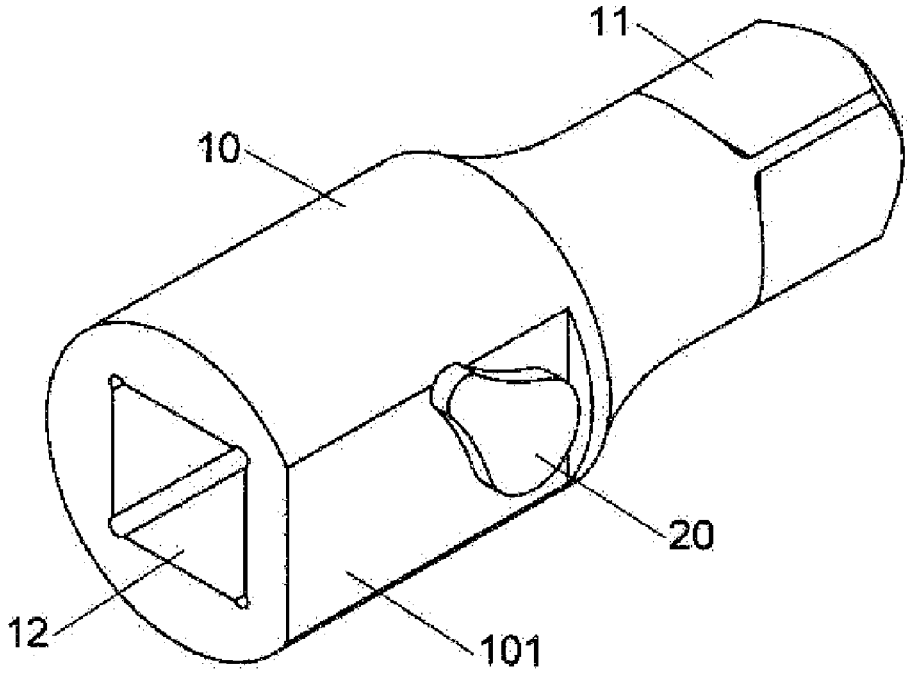
FIG. 3 is a perspective view to show the extension bar with a built-in light of the present invention.
Figure 4:
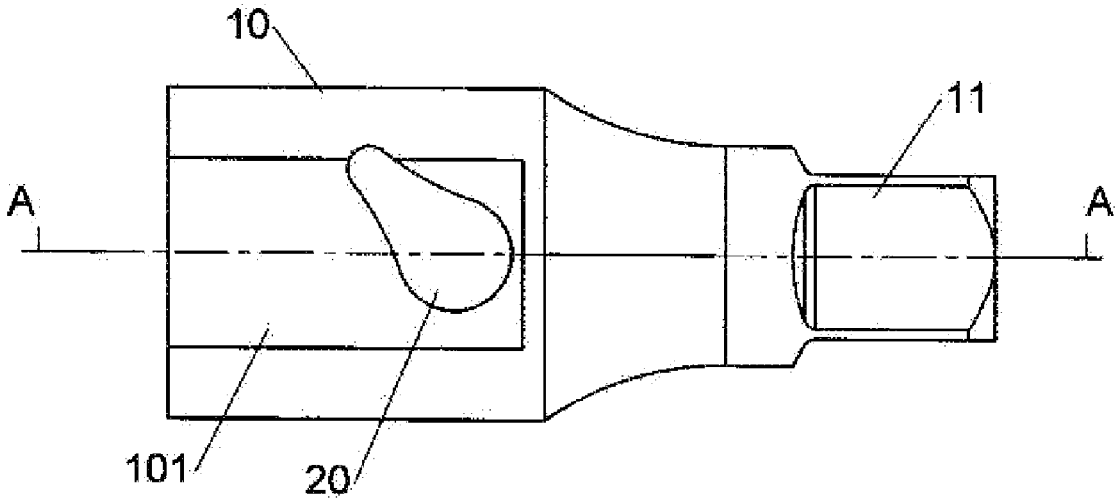
FIG. 4 is a side view to show the extension bar with a built-in light of the present invention.
Figure 5:
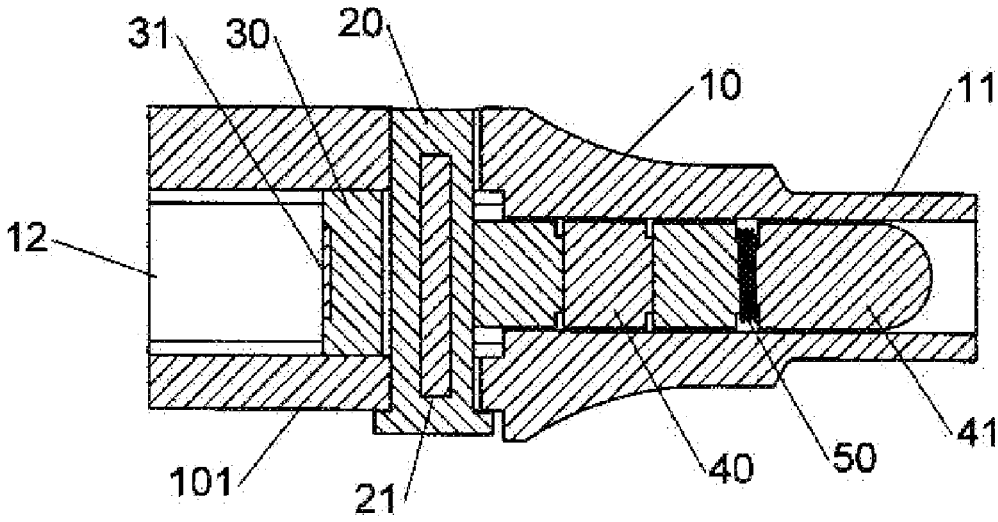
FIG. 5 is a cross sectional view taken along line A-A in FIG. 4.
Figure 6:
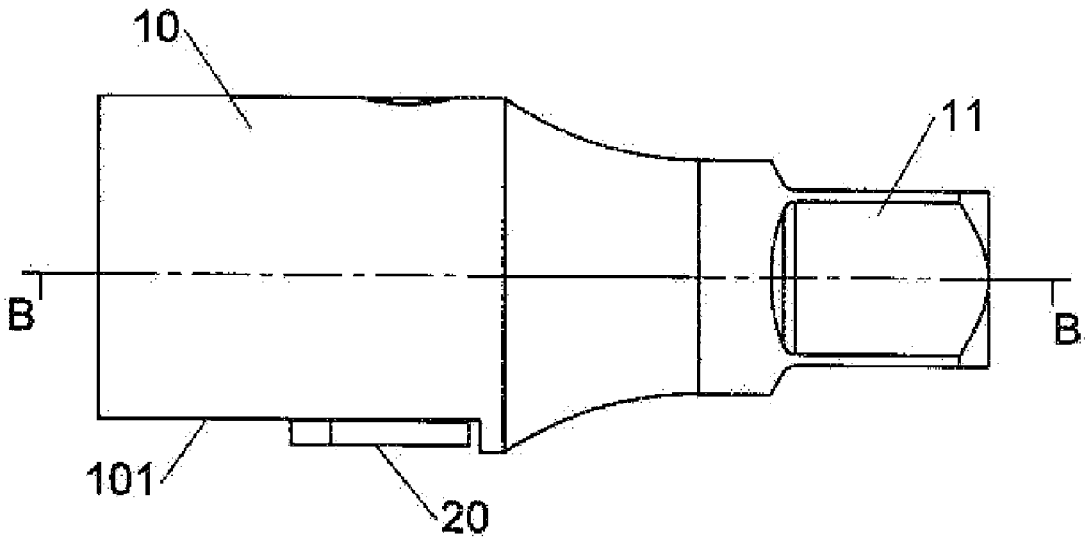
FIG. 6 is another side view to show the extension bar with a built-in light of the present invention.
Figure 7:
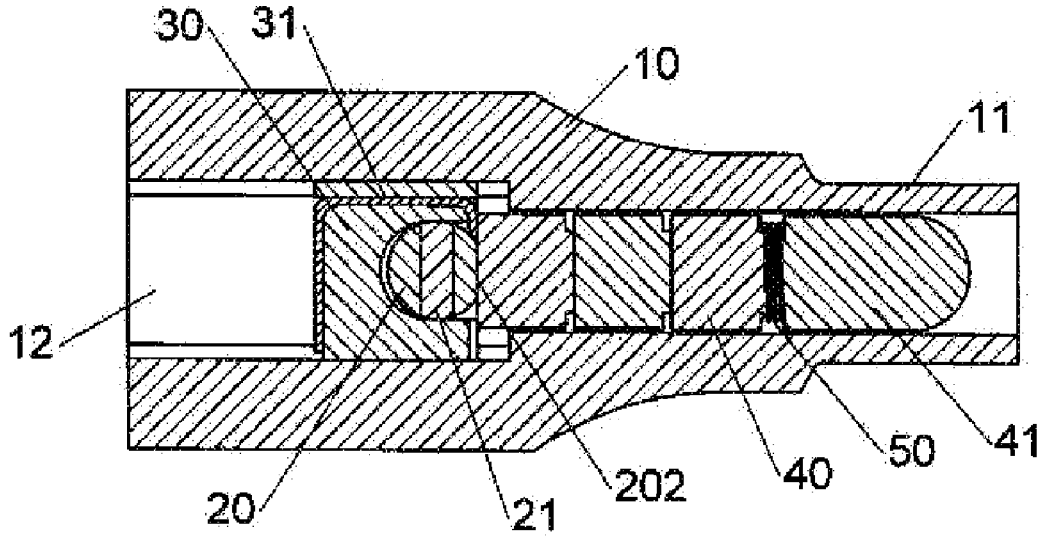
FIG. 7 is a cross sectional view taken along line B-B in FIG. 4.
Figure 8:
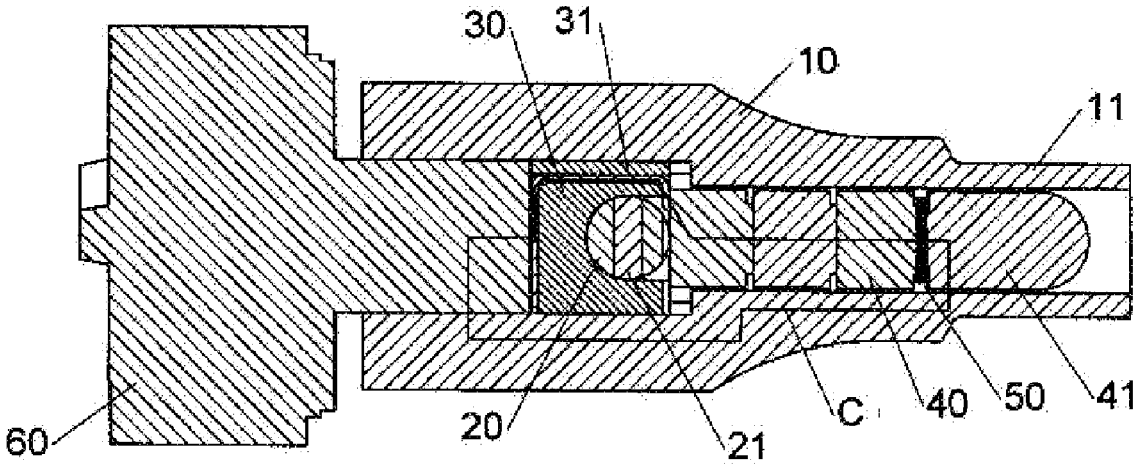
FIG. 8 is a cross sectional view to show a hand tool is inserted into the elongate body to activate the light bulb.

Referring to FIGS. 1 to 7, the extension bar with built-in light of the present invention comprises an elongate body 10 which is made by conductive material and includes a first end and a second end in which an engaging recess 12 is defined. The first end of the elongate body 10 is a rectangular end 11 so as to be connected with other hand tool and the engaging recess 12 is a rectangular recess so as to receive a conductive hand tool 60 as shown in FIG. 8. A transverse hole 13 is defined through the elongate body 10 and communicates with the engaging recess 12. A passage 14 is defined axially through the elongate body 10 and communicates with the engaging recess 12, and defines an opening in the first end of the elongate body 10. A first flat surface 101 is defined in an outer periphery of the elongate body 10.

A switch member 20 made by non-conductive material extends through the transverse hole 13 and includes a recess 201 defined axially in an outer surface thereof. A first conductive member 21 is engaged with the recess 201 and exposed on the outer surface of the switch member 20. The first conductive member 21 is in contact with an inner periphery of the transverse hole 13. A lever 203 extends laterally from an end thereof and is rested on the first flat surface 101.

A U-shaped carrier 30 made by non-conductive material is received in the engaging recess 12 and includes a vertical portion with two horizontal portions on two ends of the vertical portion. A slot 303 is defined through the vertical portion of the carrier 30 and a groove 302 is defined in the first end of the carrier 30. A recess 301 defined in the second end of the carrier 30 and a second conductive member 31 is engaged with the recess 301. The second conductive member 31 includes a first end and a second end, the first end extends through the slot 303 and extends to the first end of the carrier 30. A gap is defined between the second conductive member 31 and the elongate body 10 so that the second conductive member 31 does not contact the conductive the elongate body 10.

A power supply unit 40 and a light bulb 41 are received in the passage 14, the power supply unit 40 has a first end facing the first end of the second conductive member 31 on the carrier 30 and a second end of the power supply unit 40 faces a first end of the light bulb 41. The first end of the light bulb 41 is made by conductive material and in contact with an inner periphery of the passage 14. A second end of the light bulb 41 faces the opening in the first end of the elongate body 10. A spring 50 is located between the power supply unit 40 and the light bulb 41 so that when the power supply unit 40 is not pushed toward the light bulb 41, the power supply unit 40 and the light bulb 41 do not electrically connect. The switch member 20 is rotatably engaged with the groove 302 and a depth of the groove 302 is larger than a diameter of the switch member 20. The switch member 20 includes a second flat surface 202 defined in the outer surface thereof.

As shown in FIG. 8, when a conductive hand tool 60 is inserted into the engaging recess 12 and contacts the second end of the second conductive member 31, while the first conductive member 21 is orientated not to contact with the power supply unit 40 as shown in FIG. 8, a first circuit "C1" is formed via the conductive hand tool 60, the second conductive member 31, the conductive elongate body 10, the first end of the light bulb 41, the power supply unit 40 and the first end of the second conductive member 31.

Figure 9:
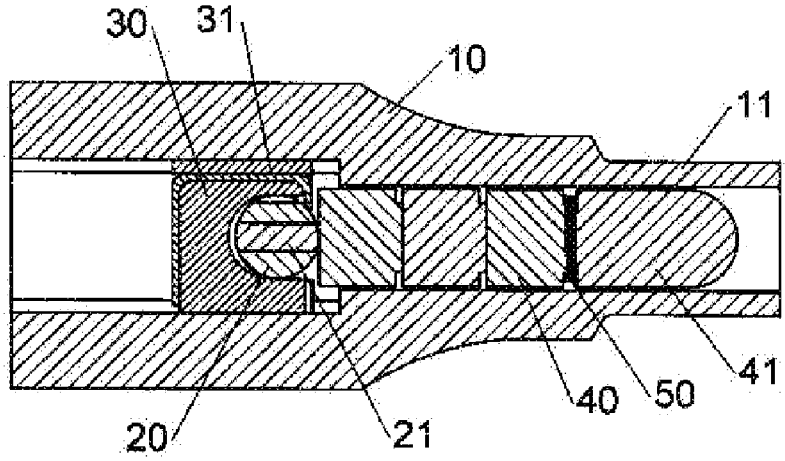
FIG. 9 is a cross sectional view to show that no hand tool is connected and the switch member is not rotated.
Figure 10:
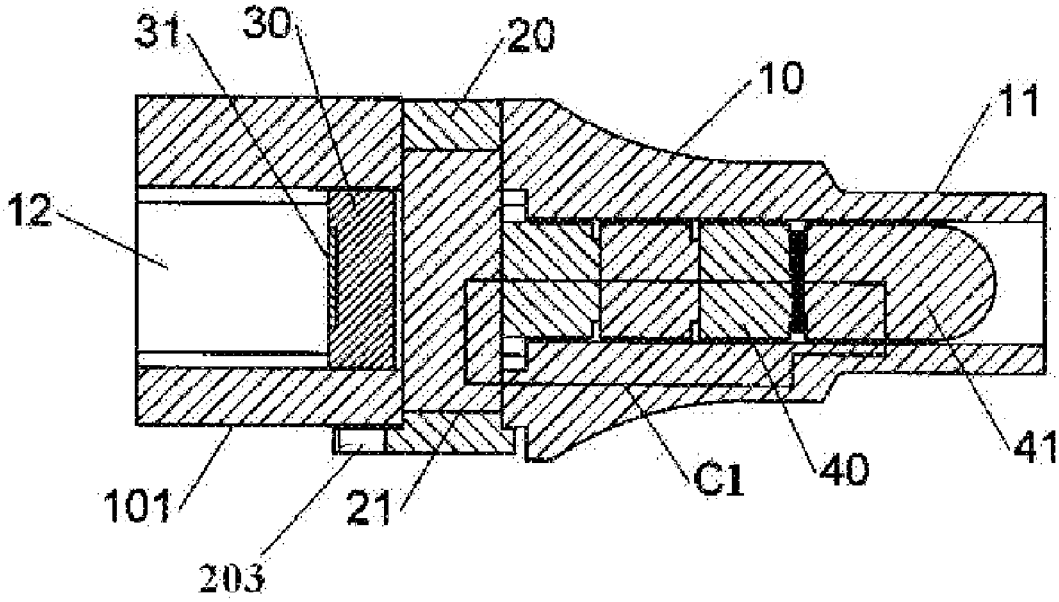
FIG. 10 is a cross sectional view to show that no hand tool is connected and the switch member is rotated to form a circuit C1.

As shown in FIGS. 9 and 10, the light bulb 41 can also be activated by simply rotating the switch member 20 to let the second flat surface 202 be in contact with the power supply unit 40. When the second flat surface 202 is in contact with the power supply unit 40, the first end of the second conductive member 31 is moved to contact the power supply unit 40 to form a second circuit "C2" via the second conductive member 31, the conductive elongate body 10, the first end of the light bulb 41, the power supply unit 40 and the first end of the second conductive member 31.

Figure 12:
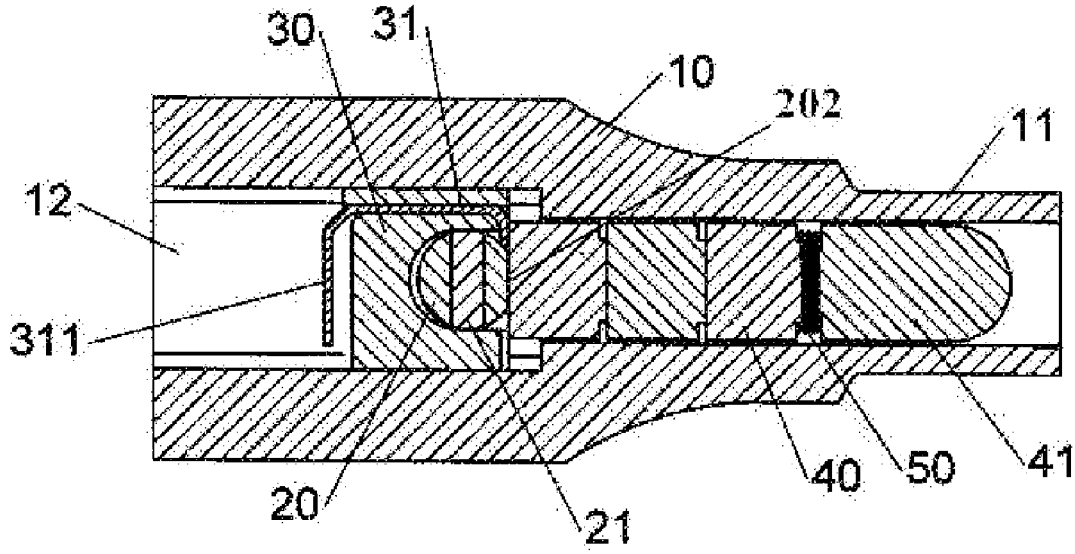
FIG. 12 shows the two ends of the second conductive member tend to move away from the carrier.
Figure 11:
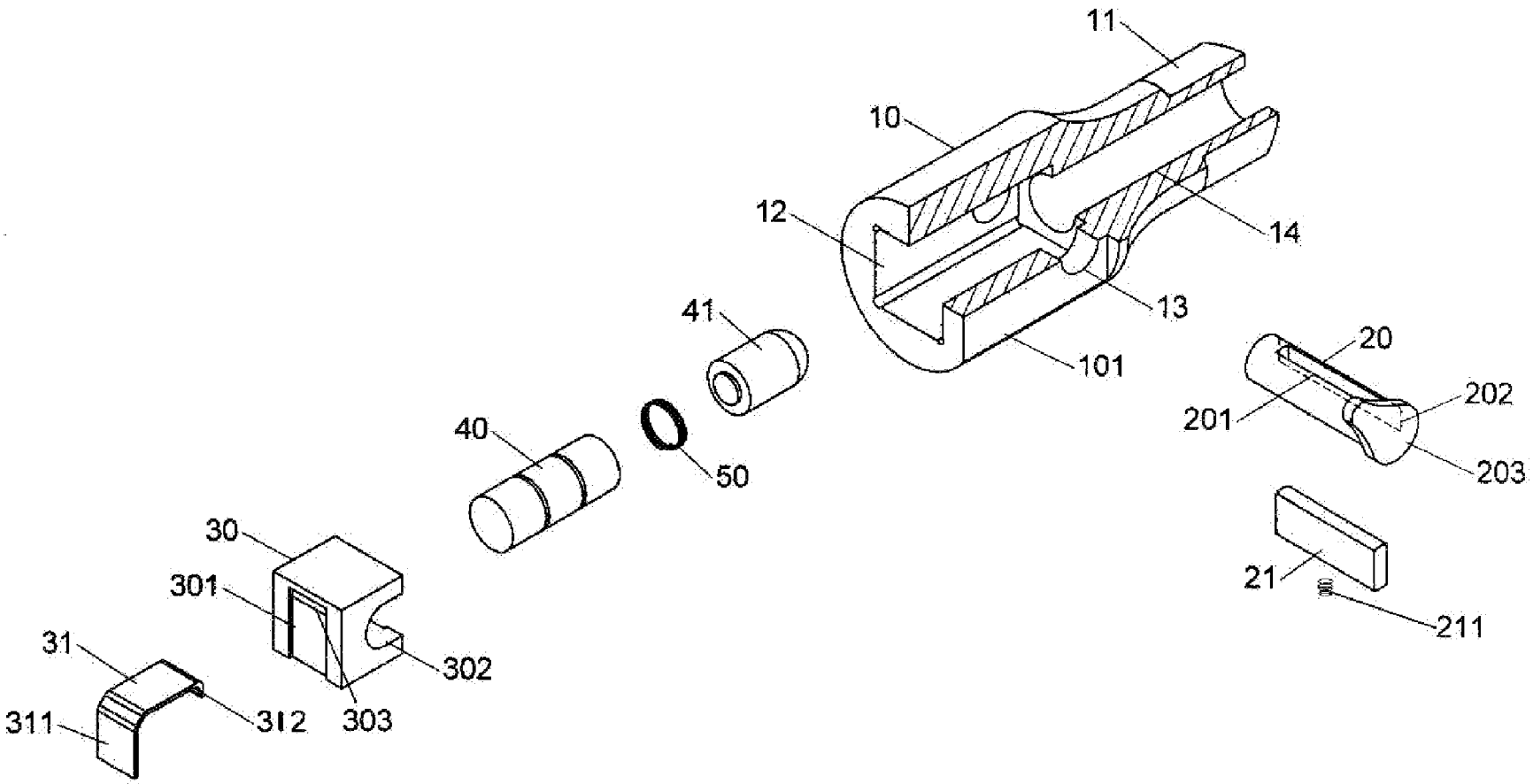
FIG. 11 is an exploded view to show another embodiment of the extension bar with a built-in light of the present invention.

FIGS. 11 and 12 show another embodiment of the extension bar wherein a spring 211 is located between the first conductive member 21 and an inner end of the recess 201 of the switch member 20, the spring 211 tends to push the first conductive member 21 away from the switch member 20 so as to ensure the first conductive member 21 to be in contact with the inner periphery of the transverse hole 13. The first and second ends 312, 311 of the second conductive member 31 are resilient and tend to expand away from the carrier 30 so that the first end of the first end 312 of the second conductive member 31 is normally in contact with the power supply unit 40. When the hand tool is inserted into the engaging recess 12, the light bulb 41 lights up.

Figure 13:
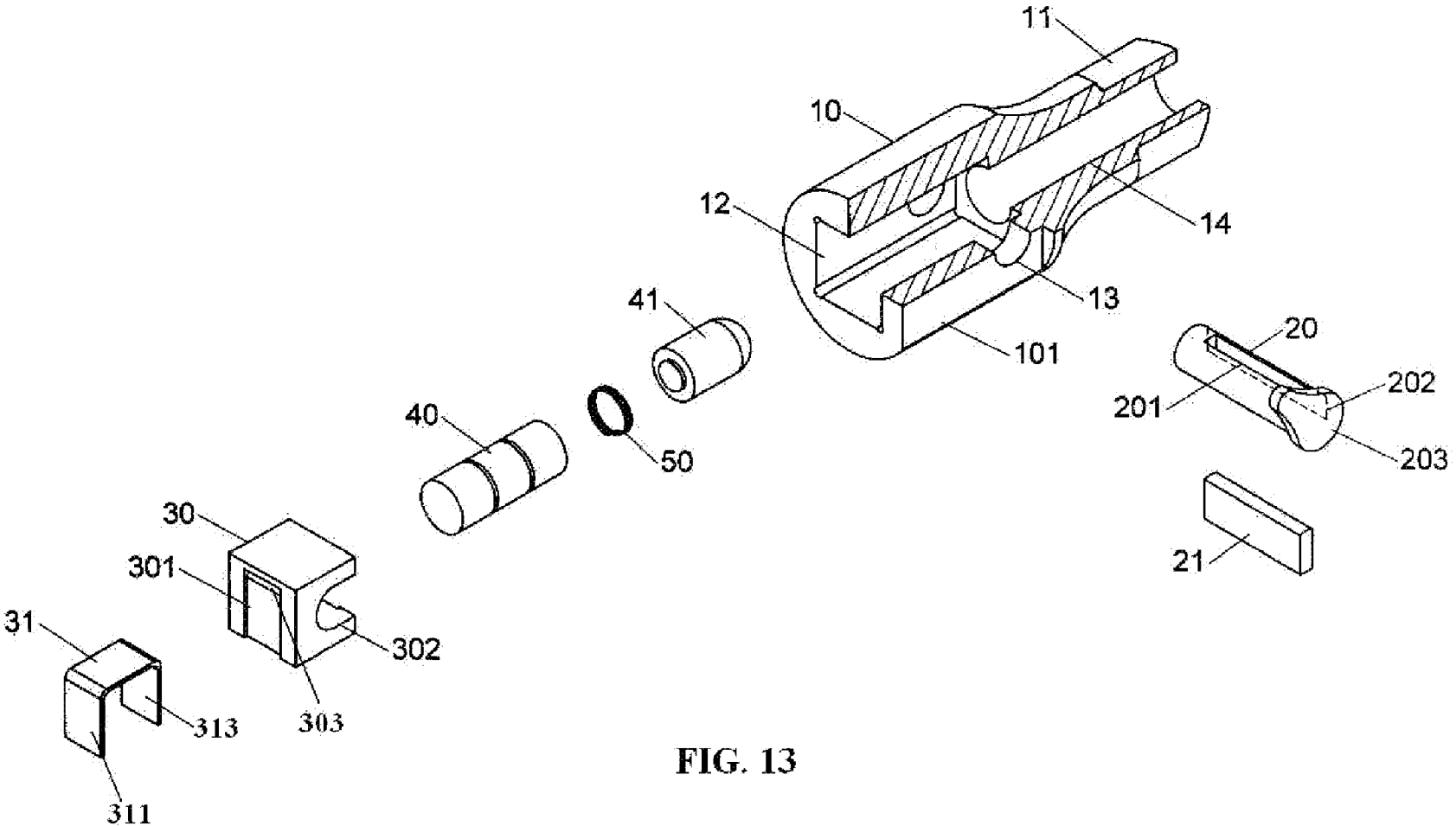
FIG. 13 is an exploded view to show yet another embodiment of the extension bar with a built-in light of the present invention.
Figure 14:
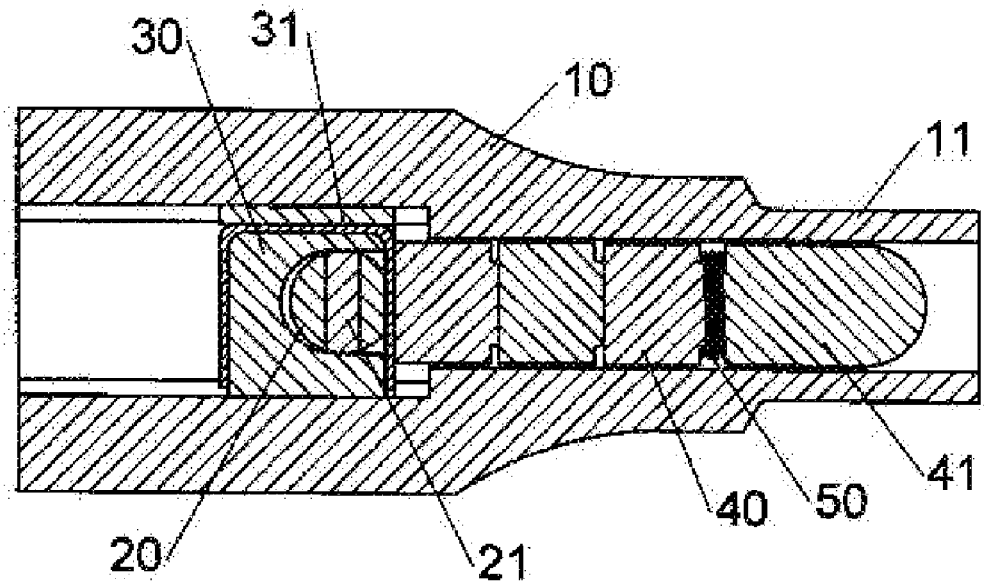
FIGS. 14 and 15 are cross sectional views to show that the switch member is rotated.
Figure 15:
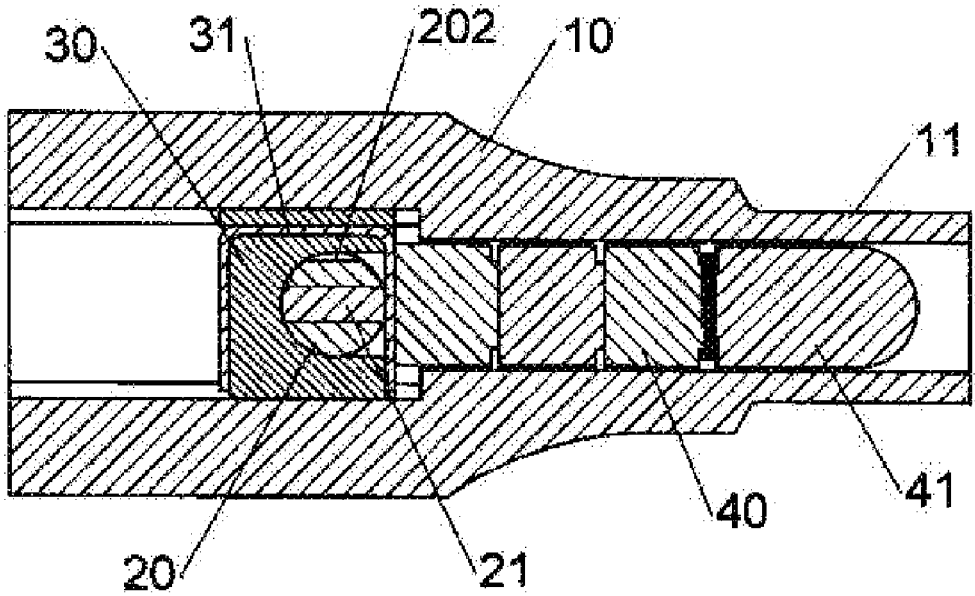

FIGS. 13, 14 and 15 show yet another embodiment of the extension bar, wherein the first end 312 of the second conductive member 31 is located on the first end of the carrier 30 and located to partially cover the groove 302 in which the switch member 20 is engaged. The first end 312 of the second conductive member 31 is in contact with the first conductive member 21 when the switch member 20 is rotated as shown in FIG. 15, the first conductive member 21, the second conductive member 31 and the power supply unit 40 are electrically in contact with each other.

Figure 16:
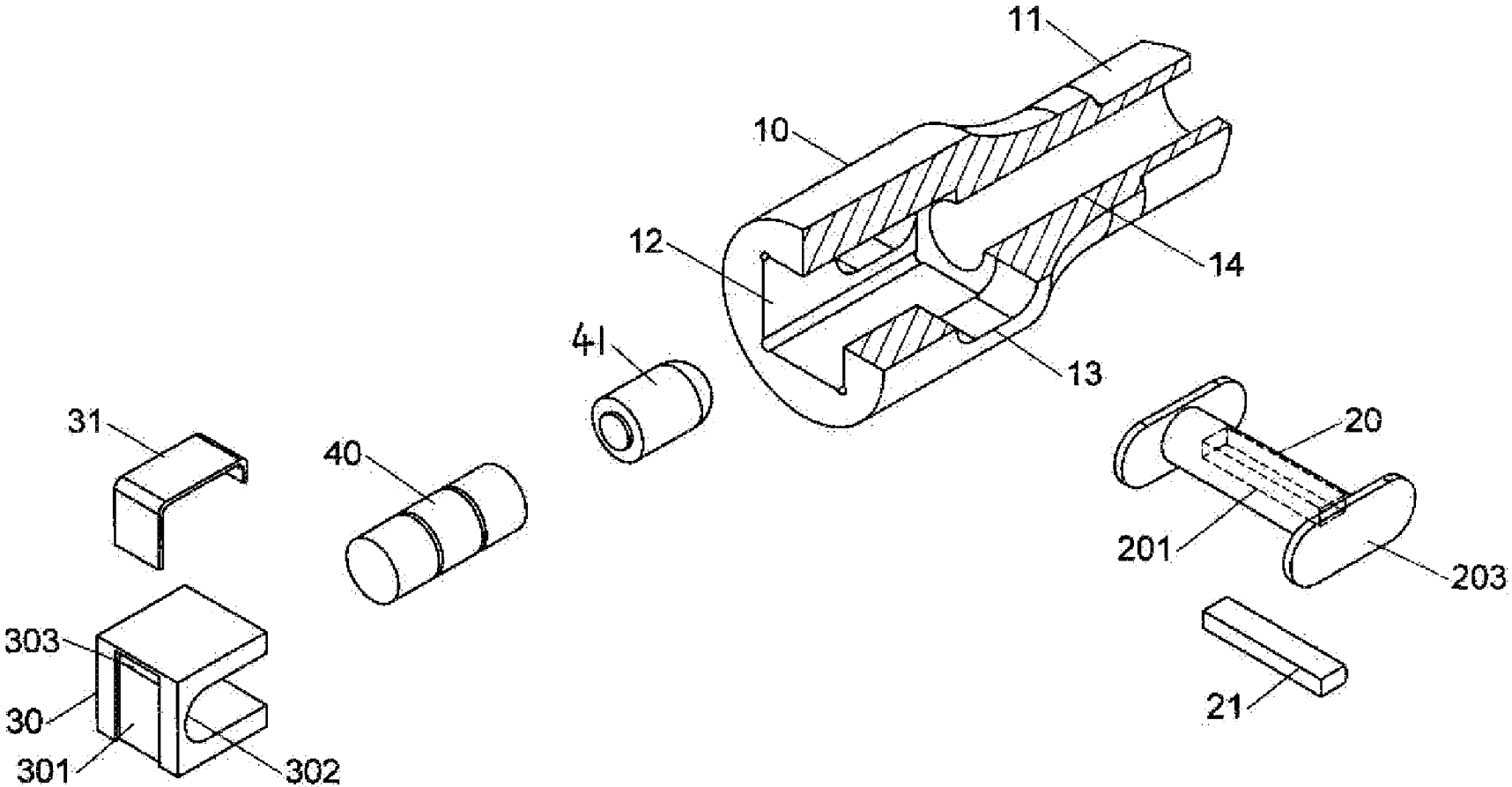
FIG. 16 is an exploded view to show a further embodiment of the extension bar with a built-in light of the present invention.
Figure 17:
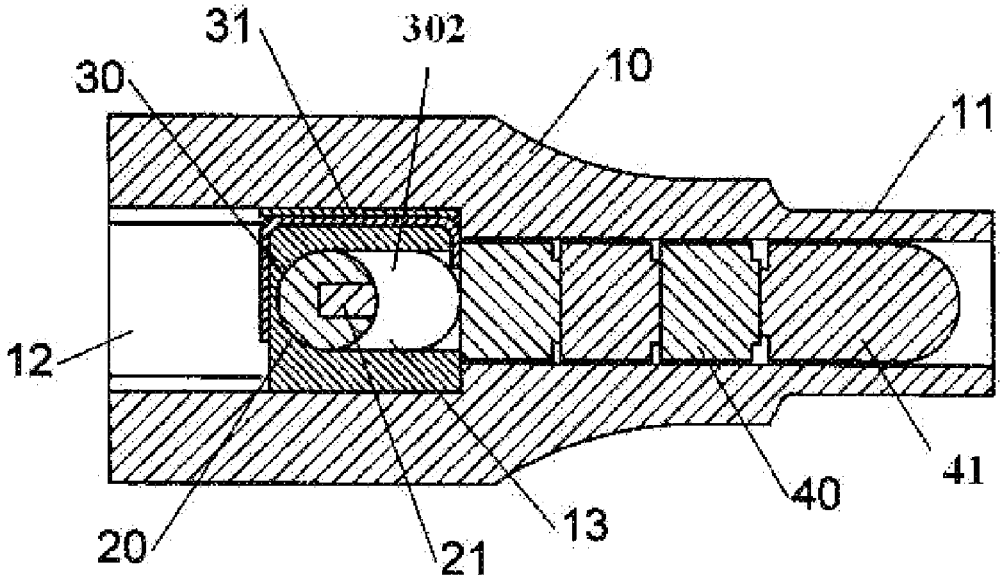
FIG. 17 is a cross sectional view to show that the switch member is movable in the elongate transverse hole.

FIGS. 16 and 17 show a further embodiment of the extension bar wherein the transverse hole 13 is an elongate hole and the switch member 20 is movably engaged with the elongate hole. When the switch member 20 is moved to the left end of the elongate hole as shown in FIG. 17, the first conductive member 21 does not contact the power supply unit 40. When the switch member 20 is moved to the right end of the elongate hole, the first conductive member 21 contacts the power supply unit 40 to activate the light bulb 41.

While we have shown and described the embodiment in accordance with the present invention, it should be clear to those skilled in the art that further embodiments may be made without departing from the scope of the present invention.

What is claimed is:

1. An extension bar with built-in light, comprising:

an elongate body made by conductive material and having a first end and an engaging recess defined in a second end of the elongate body, a transverse hole defined through the elongate body and communicating with the engaging recess, a passage defined axially through the elongate body and communicating with the engaging recess and defining an opening in the first end of the elongate body;

a switch member made by non-conductive material and extending through the transverse hole and a first conductive member connected to the switch member, the first conductive member exposed on an outer surface of the switch member and in contact with an inner periphery of the transverse hole;

a carrier made by non-conductive material and received in the engaging recess, a second conductive member connected to the carrier and having a first end and a second end, the first end extending to a first end of the carrier and the second end located at a second end of the carrier, a gap defined between the second conductive member and the elongate body, and a power supply unit and a light bulb received in the passage, the power supply unit having a first end facing the first end of the carrier and a second end of the power supply unit facing a first end of the light bulb, the first end of the light bulb made by conductive material and being in contact with an inner periphery of the passage, a second end of the light bulb facing the opening in the first end of the elongate body.

2. The extension bar as claimed in claim 1, wherein the elongate body includes a first flat surface defined in an outer periphery thereof and a lever extends laterally from an end of the switch member, the lever is rested on the first flat surface.

3. The extension bar as claimed in claim 1, wherein the first end of the elongate body is a rectangular end.

4. The extension bar as claimed in claim 1, wherein the engaging recess is a rectangular recess.

5. The extension bar as claimed in claim 1, wherein the carrier is a U-shaped member which includes a vertical portion with two horizontal portions on two ends of the vertical portion, a slot is defined through the vertical portion of the carrier.

6. The extension bar as claimed in claim 1, wherein a groove is defined in the first end of the carrier and faces the power supply unit, the switch member is engaged with the groove.

7. The extension bar as claimed in claim 6, wherein a depth of the groove is larger than a diameter of the switch member.

8. The extension bar as claimed in claim 1, wherein the carrier includes a recess defined in the second end thereof and the second conductive member is engaged with the recess.

9. The extension bar as claimed in claim 1, wherein the switch member includes a second flat surface defined in the outer surface thereof.

10. The extension bar as claimed in claim 1, wherein the switch member includes a second flat surface defined in the outer surface thereof, the second conductive member is in contact with the power supply unit when a conductive hand tool is inserted into the engaging recess and the switch member is orientated such that the second flat surface is in contact with the power supply unit.

11. The extension bar as claimed in claim 1, wherein a spring is located between the power supply unit and the light bulb so that when the power supply unit is not pushed toward the light bulb, the power supply unit and the light bulb do not electrically contact with each other.

12. The extension bar as claimed in claim 1, wherein a spring is located between the first conductive member and the switch member, the spring pushes the first conductive member away from the switch member.

13. The extension bar as claimed in claim 1, wherein the first and second ends of the second conductive member are resilient and tend to expand away from the carrier.

14. The extension bar as claimed in claim 1, wherein the first end of the second conductive member is located on the first end of the carrier and located to partially cover the groove in which the switch member is engaged, the first end of the second conductive member is in contact with the first conductive member when the switch member is rotated, the first conductive member, the second conductive member and the power supply unit are electrically in contact with each other.

15. The extension bar as claimed in claim 1, wherein the transverse hole is an elongate hole and the switch member is movably engaged with the elongate hole.

* * * * *